US005584750A

United States Patent [19]

Ishida et al.

[11] Patent Number: 5,584,750

[45] Date of Patent: Dec. 17, 1996

[54] POLISHING MACHINE WITH DETACHABLE SURFACE PLATE

[75] Inventors: Masahiro Ishida, Yokohama; Shoichi Shin, Shizuoka-ken; Masafumi Tsunada, Numazu; Yasuhiko Nagakura, Numazu; Toshio Oishi, Numazu, all of Japan

[73] Assignees: Toshiba Machine Co., Ltd., Tokyo; Kabushiki Kaisha Toshiba, Kawasaki, both of Japan

[21] Appl. No.: 523,963

[22] Filed: Sep. 6, 1995

[30] Foreign Application Priority Data

Sep. 7, 1994 [JP] Japan ..... 6-213465

[51] Int. Cl.[6] ..... B24B 29/00

[52] U.S. Cl. ..... 451/288; 451/56; 451/290; 451/446; 451/550

[58] Field of Search ..... 451/45, 56, 59, 451/60, 285, 287, 288, 290, 446, 533, 550

[56] References Cited

U.S. PATENT DOCUMENTS

| | | | |
|---|---|---|---|
| 3,305,976 | 2/1967 | Koskie | 451/59 |
| 3,866,361 | 2/1975 | Mauck | 451/490 |
| 4,490,948 | 1/1985 | Hanstein et al. | 451/446 X |
| 4,674,236 | 6/1987 | Kawakami et al. . | |
| 5,136,820 | 8/1992 | Luther | 451/59 X |
| 5,216,843 | 6/1993 | Breivogel et al. | 451/550 X |
| 5,269,102 | 12/1993 | Wood | 451/550 |
| 5,516,400 | 5/1996 | Pasch et al. | 451/56 X |

FOREIGN PATENT DOCUMENTS

| | | | |
|---|---|---|---|
| 61-90869 | 5/1986 | Japan . | |
| 62-136367 | 6/1987 | Japan . | |
| 63245365 | 10/1988 | Japan | 451/446 |
| 192065 | 4/1989 | Japan | 451/550 |
| 4-79790 | 12/1992 | Japan . | |

*Primary Examiner*—Timothy V. Eley
*Attorney, Agent, or Firm*—Oblon, Spivak, McClelland, Maier & Neustadt, P.C.

[57] ABSTRACT

The present invention uses a surface plate 8 made of carbon fiber reinforced plastics which is installed on a turntable 4, and an emery cloth 6 is adhered on the surface of the surface plate 8. This surface plate 8 is detachably installed on the turntable 4 by means of key blocks 22 or screws 26. If the turntable 4 is made of carbon fiber reinforced plastics, the entire weight of a polishing machine can be reduced.

3 Claims, 2 Drawing Sheets

POLISHING MACHINE WITH DETACHABLE SURFACE PLATE

BACKGROUND OF THE INVENTION

1. Field of the Invention

The present invention relates to a polishing machine particularly used for polishing a work piece, such as a semiconductor wafer or the like, which requires a high flatness.

2. Description of the Related Art

A conventional polishing machine comprises a turntable, a head, and a polishing agent supply device. The turntable is made of cast iron, aluminum, stainless steel or the like. An emery cloth is adhered on the surface of the turntable by an adhesive agent such as a double coated adhesive tape. The head is provided so as to oppose the turntable. A work piece is retained by the head. The polishing agent supply device supplies a polishing agent onto the emery cloth.

A work piece is polished as follows. The turntable wearing an emery cloth adhered on its surface is rotated, to supply a polishing agent onto the polishing cloth by the polishing agent supply device. Subsequently, while the work piece is rotated by the head and is simultaneously reciprocated in a radial direction of the turntable, the surface of the work piece is pressed against the emery cloth.

In this polishing machine, to finish the surface of a work piece at an excellent flatness, the flatness of the surface of the turntable naturally must be excellent. In addition, unless an emery cloth is adhered uniformly on the turntable, an excellent flatness of the surface of the work piece cannot be obtained. Further, since the emery cloth is much softer than the turntable and a strong force effects on the emery cloth when polishing the work piece, the emery cloth must be securely adhered on the turntable.

In general, an emery cloth is manufactured by subjecting an unwoven polyurethane cloth to foaming processing and buff-processing. An emery cloth is gradually abrased during polishing, and therefore, must be replaced at a predetermined operation cycle. Since a conventional polishing machine is constructed such that an emery cloth is directly adhered on a turntable, the emery cloth is manually replaced with hands, on the turntable in an operation room where the polishing machine is placed.

Therefore, a conventional polishing machine results in following problems, with respect to operations for replacing emery clothes on the turntable.

(a) Since an emery cloth is securely adhered on the surface of the turntable, the cloth cannot easily be peeled off with hands.

(b) Since a replacement of an emery cloth takes a long time for which the polishing machine must be stopped, the productivity of the machines is low.

(c) When the polishing machine is placed in an operation room on a production line for semiconductors or the like where cleanliness is required, a replacement of an emery cloth is carried out in the room. As a result, polishing agents and shavings are scattered in the room, and the cleanliness of the room is lowered.

To maintain the flatness of the surface of the turntable during polishing, the following characteristics are demanded for a turntable.

(a) Deformation is small against a pressure.

(b) Deformation caused by a heat generated during polishing is small.

To satisfy these requirements, a conventional turntable is generally made of material, e.g., cast iron, aluminum, stainless steel, or the like. Therefore, the weight of a turntable is considerably large. For example, in case of a turntable made of cast iron and having a diameter of 600 mm and a thickness of 100 mm, the weight reaches 206 kg. As a result, the entire weight of a polishing machine is extremely large.

Meanwhile, in many cases, factory buildings for manufacturing semiconductor have a plurality of floors. In second or higher floors of such buildings, normally, the withstand load is not considerably high. In these cases, it is difficult to place polishing machines on a second or higher floor, and this is one of the limitations to lay-out designs semiconductor production line.

SUMMARY OF THE INVENTION

The object of the present invention is to provide a polishing machine in which:

a. Replacement of emery cloths is easy and takes only a short time.

b. During the replacement of emery cloths, the polishing machine can be operated with use of another surface plate prepared previously.

c. The replacement of emery cloths does not cause a reduction in cleanliness in the operation room.

d. The polishing machine is not so heavy, and can be installed easily.

e. The processing accuracy is higher than that of a conventional machine.

As means for achieving the above object, the present invention uses a surface plate made of carbon fiber reinforced plastics, which is mounted on a turntable, and an emery cloth is adhered on the surface of the surface plate. This surface plate is mounted on the turntable with use of a key block such that the disc is detachable from and attachable to the turntable. Otherwise, the surface plate may be mounted by a screw or a vacuum suction. It is desirable that the turntable is made of carbon fiber reinforced plastics, too.

Carbon fiber reinforced plastics used in the present invention is of a type widely used in airplanes, ships, shafts of golf clubs, and the likes. This material has a form of a thin tape, and a surface plate is formed of tapes of this material multi-layered and oriented in different directions.

In the above structure, since the surface plate is mounted on the turntable to be detachable therefrom, an emery cloth can be replace together with the surface plate. As a result, replacement of emery clothes is facilitated, and is completed in a short time period. The polishing machine can be operated while peeling off an emery cloth and adhering a new emery cloth, and therefore, the productivity of the machine can be improved. In addition, since replacement of emery cloths can be carried out in another room than an operation room where the polishing machine is placed, an emery cloth can be replaced without lowering cleanliness in the operation room.

Further, since the surface plate is made of carbon fiber reinforced plastics having a high mechanical strength and a small coefficient of liner expansion, mechanical deformation and thermal deformation are both reduced, so that the flatness of a surface plate during polishing is maintained in an excellent state, i.e., the flatness is maintained at 5 μm or less (where the diameter of the disc is 600 mm). Therefore it is possible to finish the surface of a work piece with an excellent flatness, e.g., 0.1 to 0.5 (where a wafer has a diameter of 150 mm). In addition, the carbon fiber reinforced plastics is of a light weight, which facilitates services for attaching the surface plate to or detaching it from the turntable.

In addition, if a turntable is made of carbon fiber reinforced plastics, following advantages can be obtained. Generally, a turntable is made of such material which has a small coefficient of linear expansion in order to limit thermal deformation during polishing to be small, and a conventional turntable is made of cast iron because of its size and process easiness. Cast iron has a Young's modulus of 13,000 $kg/mm^2$ and a density of 7.30 $g/cm^3$, while carbon fiber reinforced plastics has a Young's modulus of 5,000 $kg/mm^2$ and a density of 1.55 $g/cm^3$. Since a displacement of material caused by a pressure is inversely proportional to the Young's modulus, the ratio of the thickness of a turntable made of carbon fiber reinforced plastic to the thickness of a turntable made of cast iron is 13,000/5,000=2.6 where these two turntables have an equal diameter and an equal displacement. The ratio of the weight of the turntable made of carbon fiber reinforced plastics to that of the iron cast turntable is 2.6×(1.55/7.3)=0.55, which is about half of the iron cast.

The heaviest component among components constituting a polishing machine is a turntable, and for example, an iron cast turntable weights 206 kg where the turntable has a diameter of 600 mm and a thickness of 100 mm as described above. A turntable made of carbon fiber reinforced plastics, having the same diameter, weights about 113 kg which is lighter by 93 kg than that iron cast turntable. Thus, if the turntable is made of carbon fiber reinforced plastics, the weight of a polishing machine can be greatly reduced, and as a result, the limitation concerning a place where the polishing machine is placed can be eliminated.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

An embodiment of the present invention will be explained below with reference to an example thereof.

Figure 1:
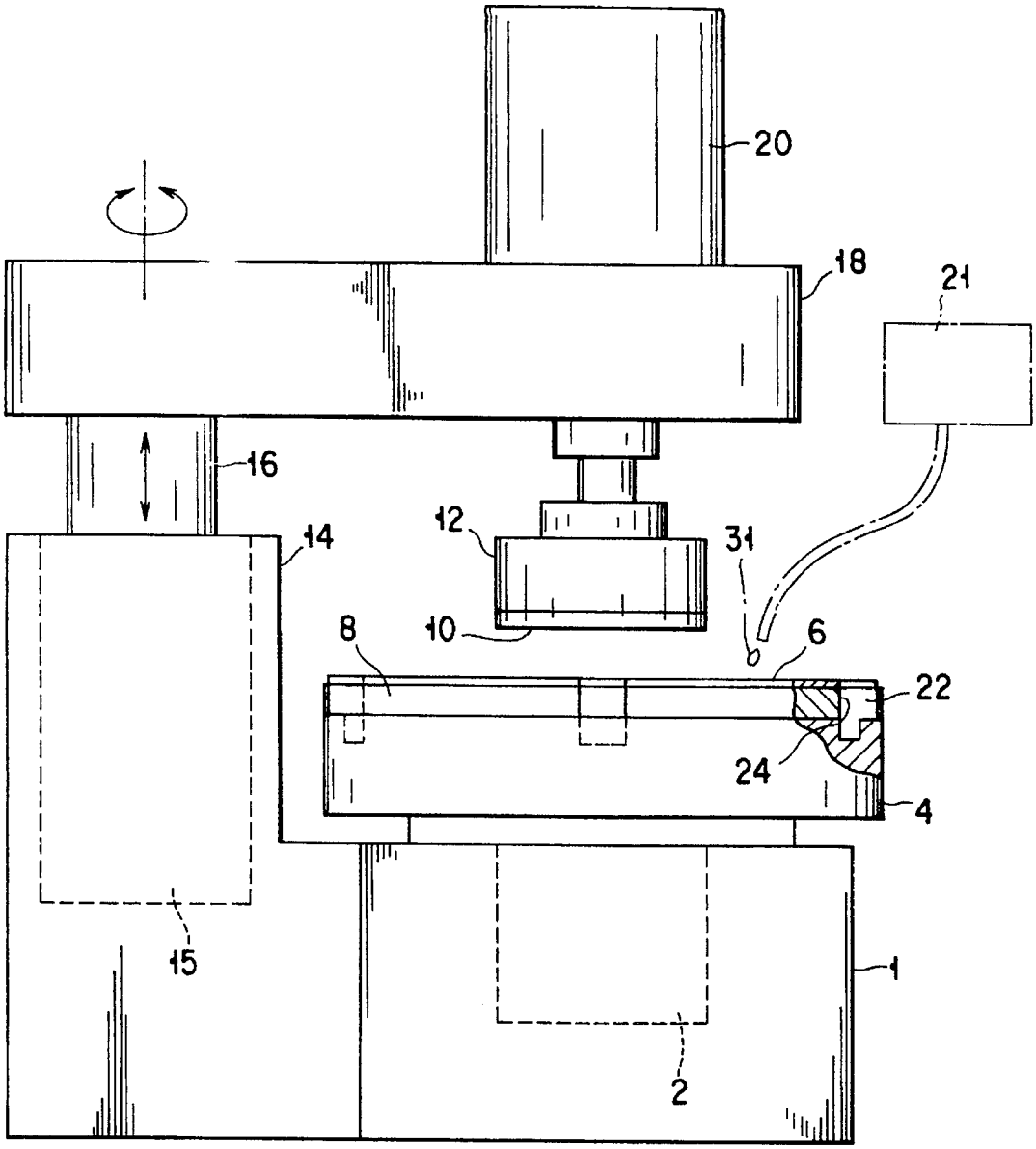
FIG. 1 is a side view showing the entire structure of a polishing machine according to an embodiment of the present invention.

FIG. 1 shows the entire structure of a polishing machine according to the present invention. In this figure, references 4, 8, 6, 10, 12, and 21 respectively denote a turntable, a surface plate, an emery cloth, a work piece, a head, and a polishing agent supply device.

The turntable 4 is supported on a base 1 and is driven to rotate by a motor 2 contained inside the base 1. A surface plate 8 made of carbon fiber reinforced plastics (CFRP) is installed on the upper surface of the turntable 4 by a key block 22. An emery cloth 6 is adhered on the surface of the surface plate 8.

A head 12 for retaining a work piece 10 is provided above the surface plate 8. The head 12 is installed near an end of a swing arm 18, and the swing arm 18 is supported by a column 14 through a swing shaft 16. The swing arm can be elevated up and down and rotated by an arm drive device 15 contained in the column 14. Further, the head 12 is driven to rotate by a motor 20.

Polishing operation is performed in the following manner.

A surface plate 8 is rotated by a turntable drive motor 2, and a head 12 is rotated by a head drive motor 20. Then, an arm drive device 15 is operated to move down the head 12, while pressing a work piece 10 against an emery cloth 6 on the surface plate 8. Further, the head 12 is operated to reciprocally move in the radial direction of the surface plate. In this state, a polishing agent 31 is supplied onto the emery cloth 6 by means of a polishing agent supply device 21, thereby to polish the work piece 10.

Figure 2:
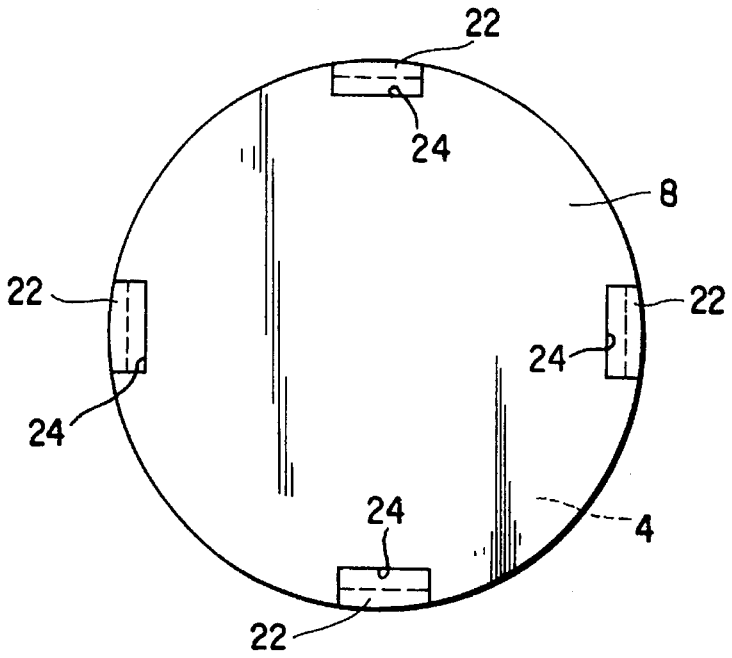
FIG. 2 is a plan view showing a surface plate according to the embodiment of the present invention.

FIG. 2 shows a state in which the surface plate 8 is installed on a turntable 4 by means of key blocks 22. Key blocks 22 are attached to four portions on the periphery of the turntable 4, while key grooves 24 are formed in the surface plate 8. The key blocks 22 are engaged in the key grooves 24, thereby fixing the surface plate to the turntable 4. To securely fix the surface plate, at least four key grooves 24 should preferably be provided. Each key groove is arranged to include a margin in the radial direction. Such margins prevent deformation of the surface plate caused by a difference in thermal expansion amount in the radial direction between the surface plate and the turntable.

In addition, the key blocks 22 themselves may be kept fixed to the turntable 4 or may be detachable fixed thereto. Further, the turntable 4 may be provided with vacuum holes at several portions, which are used to suck and fix the surface plate 8 during polishing and which release its vacuum force during replacement of the emery cloth 6 so that the emery cloth together with the surface plate 8 can be replaced.

Figure 3:
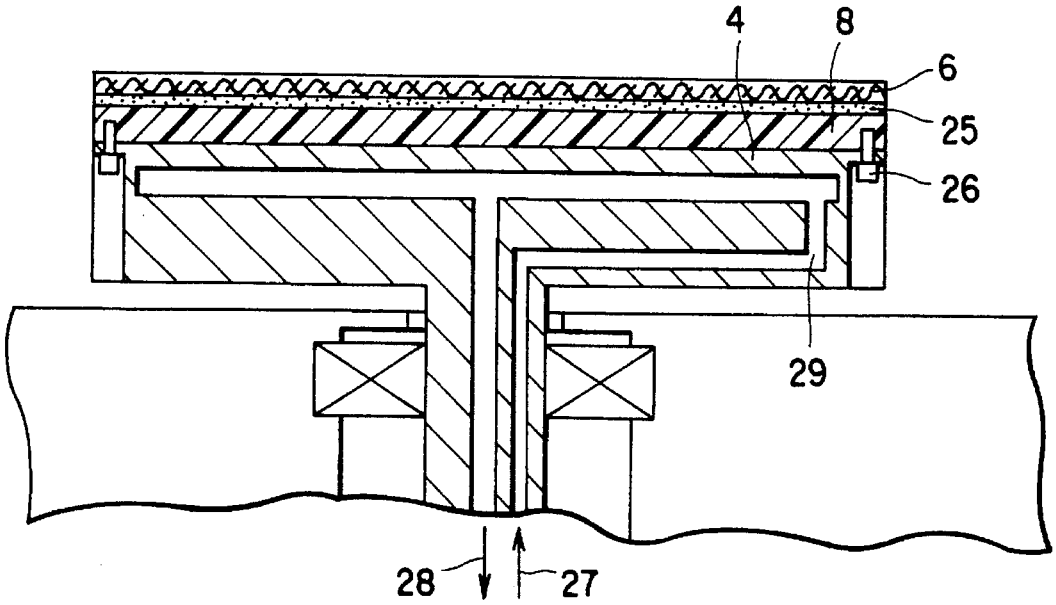
FIG. 3 is a cross-section showing a surface plate according to another embodiment of the present invention.

FIG. 3 is a cross-sectional structure of the turntable 4. In this figure, a reference 29 denotes a flow path of cooling water formed in the turntable 4, and references 27 and 28 indicate directions of cooling water flowing through the path. In this example, screws 26 are used to fix the surface plate 8 to the turntable 4. A plurality of screws are uniformly provided along the periphery of the turntable 4.

Material of steel, aluminum, and carbon fiber reinforced plastics (CFRP) respectively has densities of 7.85 $g/cm^3$, 2.70 $g/cm^3$, and 1.55 $g/cm^3$. Supposing that the surface plate 8 has a diameter of 600 mm and a thickness of 10 mm, the weights of the surface plates made of steel, aluminum, and carbon fiber reinforced plastics are respectively 22.2 kg, 7.6 kg, and 4.4 kg. Estimated only from the weights of these surface plates, there is not a large difference between the plate made of aluminum and that made of carbon fiber reinforced plastics. However, aluminum has a coefficient of linear expansion of $23.9\times10^{-6}$/°C. which is greater than the coefficient of liner expansion of carbon fiber reinforced plastics in the direction of its fibers, i.e., about $-2.0\times10^{-6}$/°C. Therefore, in case of using a surface plate made of aluminum, a large deformation is caused by heat locally generated during polishing. On the contrary, a surface plate made of carbon fiber reinforced plastics has a minus coefficient of linear expansion in its fiber direction and a coefficient of liner expansion of about $5\times10^{-6}$/°C. at an angle of 45°, so that the coefficient linear expansion , i.e., the deformation caused by heat can be properly controlled to be small as a whole, by adjusting the direction of the fibers.

In case of using a surface plate 8 made of carbon fiber reinforced plastics and having a thickness of 10 mm, deformation of the surface plate caused by pressing a work piece 10 against the plate is 0.2 μm which is small enough to be negligible where the surface pressure of 300 g/cm$^2$ (which is a pressure ordinarily used) is applied.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A polishing machine comprising:

a turntable;

a surface plate made of carbon fiber reinforced plastics, detachably attached onto the turntable, and provided with an emery cloth adhered on a surface of the surface plate;

a head provided so as to oppose the surface plate, for retaining a work piece, for reciprocally moving the work piece in a radial direction of the surface plate, and for rotating the work piece, with the work piece pressed against a surface of the emery cloth; and polishing agent supply means for supplying the emery cloth on the surface plate with a polishing agent.

2. A polishing machine according to claim 1, wherein the surface plate is attached onto the turntable by key blocks.

3. A polishing machine according to claim 1, wherein the turntable is made of carbon fiber reinforced plastics.

* * * * *